US006040023A

United States Patent [19]

Salerno

[11] Patent Number: 6,040,023

[45] Date of Patent: Mar. 21, 2000

[54] DECORATIVE TREE DEVICE

[76] Inventor: Anthony J. Salerno, 3252 Banta Rd., South Plainfield, N.J. 07080

[21] Appl. No.: 09/078,782

[22] Filed: May 14, 1998

[51] Int. Cl.[7] ..... A01N 1/00

[52] U.S. Cl. ..... 428/16; 428/19; 428/8

[58] Field of Search ..... 428/18, 19, 20, 428/16, 7, 8; D11/121; 29/525.05, 525.01

[56] References Cited

U.S. PATENT DOCUMENTS

| | | | |
|---|---|---|---|
| 2,941,331 | 6/1960 | Ottolini | 428/18 X |
| 3,967,019 | 6/1976 | Magee | 428/18 X |
| 4,330,953 | 5/1982 | Damiano | 428/18 X |
| 4,543,278 | 9/1985 | Ackerman | 428/18 |
| 4,781,643 | 11/1988 | Holloway et al. | 428/18 X |
| 4,923,721 | 5/1990 | Gilmore . | |
| 5,277,948 | 1/1994 | Daun | 428/18 X |
| 5,413,825 | 5/1995 | Chaikin | 428/18 |
| 5,487,925 | 1/1996 | Simmel et al. | 428/18 X |

*Primary Examiner*—Deborah Jones
*Assistant Examiner*—Wendy Boss
*Attorney, Agent, or Firm*—Lerner, David, Littenberg, Krumholz & Mentlik, LLP

[57] ABSTRACT

A decoration for a tree and method of decorating a tree includes figurines, an elongate decorative flexible member arranged between the figurines and an elongate spacer attached to a tree for spacing the figurines from the tree, thereby providing the appearance that the figurines are decorating the tree with the decorative member.

22 Claims, 2 Drawing Sheets

DECORATIVE TREE DEVICE

BACKGROUND OF THE INVENTION

The present invention relates generally to tree decorations, and more specifically to a tree decoration which emulates the process of decorated by living or other things.

Tree decorations of many types have existed for thousands of years. Such decorations take on many forms. However, most of these decorations do not "interact" with one admiring a decorated tree such that one imagines a decorative process. Most of these decorations do not emulate such a decorative process in such a way that the decoration has more than ornamental or entertainment value. Most do not have an intrinsic value which instigates one's imagination to perceive a decorative process underway.

SUMMARY OF THE INVENTION

In a preferred embodiment, the present invention relates to a method of decorating a tree by attaching a figurine to a tree or adjacent to a tree, arranging the first end of an elongate decorative member at least adjacent to the figurine, extending the elongate decorative member on or adjacent to the tree, and arranging the second end of the elongate decorative member at least adjacent to the tree.

The second end of the elongate decorative member is preferably arranged at a location remote from the first end of the elongate decorative member. The figurine can be attached to a tree branch by an elongate spacer so that it is spaced from the tree. The elongate decorative member may be attached to the figurine or to the tree. Preferably, the elongate decorative member is used to at least partially occlude the elongate spacer. They could be built together as well as an integral unit or where the elongate decorative member encompasses the elongate spacer.

The elongate spacer may be made integral with a fastener for fastening the elongate spacer to the tree. Indeed, the elongate decorative member, a ribbon in one of the preferred embodiments, may encompass the fastener which is in the form of, for instance, a wire-like member. Also, the elongate decorative member may be somewhat rigid, but bendable, but is preferably flexible, as in a piece of ribbon or string of pearls, so as to drape across the tree if arranged substantially horizontally.

The invention also contemplates a second figurine, whereby the arrangement on the tree would be such that the elongate decorative member appears to be held between the figurines. And in such an arrangement, both figurines may be spaced from the tree by an elongate spacer, or one may be spaced and the other directly on the tree, or both can be directly on the tree.

The invention also relates to a tree decoration including a figurine, an elongate decorative member attached to the figurine and a fastener that will fasten the figurine to a tree. Preferably, such a tree decoration further includes an elongate spacer for attachment to the figurine so as to space the figurine from a tree. Preferably, a second figurine is also provided, and a second elongate spacer. The elongate decorative member is preferably attached to the figurine and arranged with respect to the elongate spacer so that the elongate decorative member at least partially occludes a view of the elongate spacer. The elongate decorative member may be rigid, but bendable; but is preferably loosely flexible so that it may drape when arranged about a tree.

The invention is further directed to a decorative article of manufacture including a tree, first and second figurines spaced from one another and arranged with respect to the tree, at least one elongate spacer arranged between at least one of the figurines and the tree so as to space the at least one figurine from the tree, a fastener for fastening at least one elongate spacer to the tree, and an elongate flexible member extending between the first and second figurines.

Preferably the elongate spacer and fastener are integrally made or at least provided as a single piece. A wire-like device is preferred so that it may be wrapped around a branch of a tree.

DETAILED DESCRIPTION OF THE PREFERRED EMBODIMENT

Figure 1:
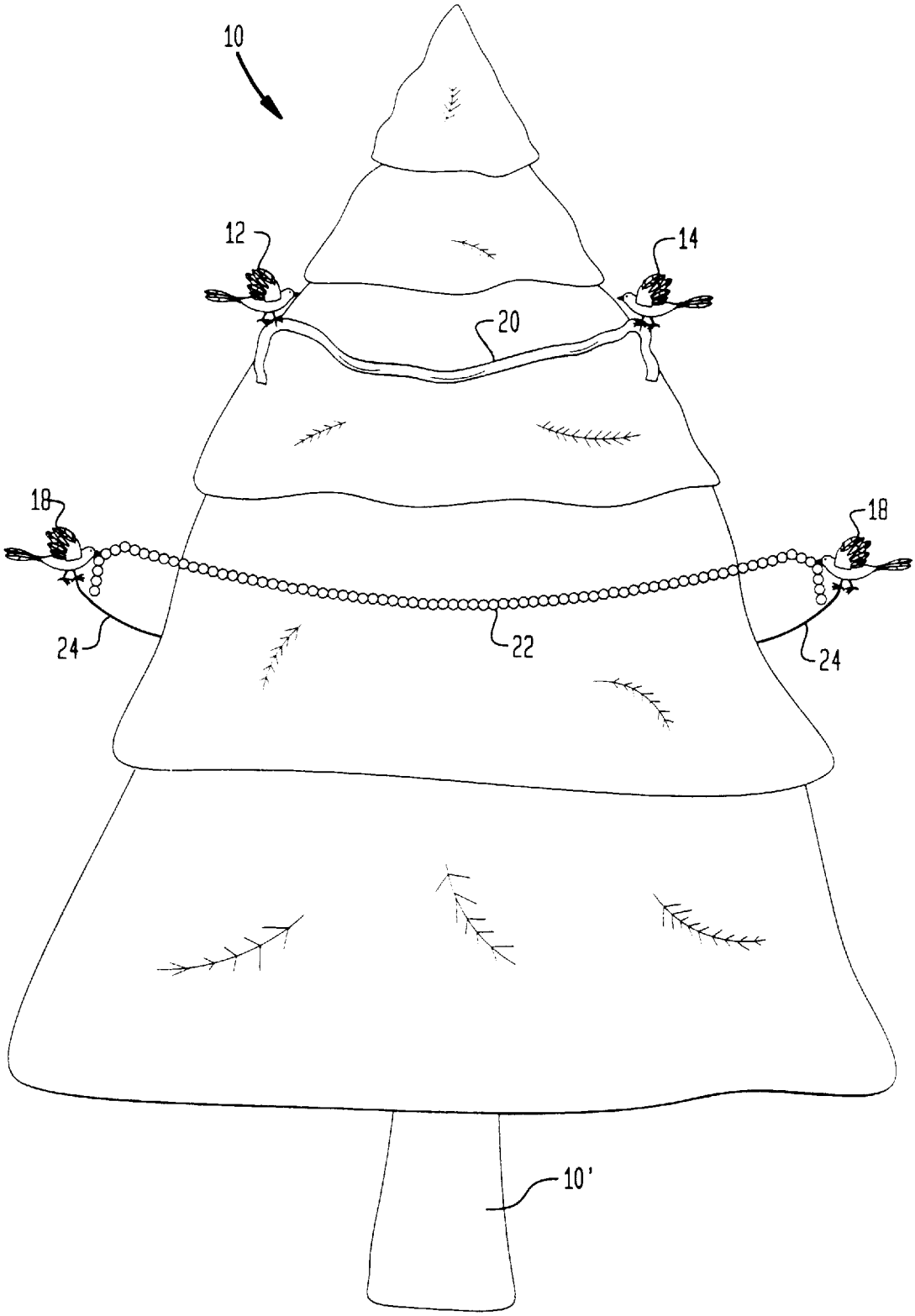
FIG. 1 is an elevational view of an embodiment of the present invention, illustrating a Christmas tree having thereon two pairs of bird figurines, one pair carrying a decorative ribbon and the other pair carrying a string of faux pearls.

FIG. 1 illustrates a Christmas tree on which there are pairs of bird figurines emulating the decorative process of decorating a tree with a ribbon and a string of faux pearls. The Christmas tree is generally designated as 10, and the bird figurines bear references 12 and 14 for the first pair, and references 16 and 18 for the second pair.

The "figurines" in accordance with the present invention need not be birds, but instead can be anything at all, including animals, people, fictional characters, imaginative characters, cherubs and seraphims. Illustrated in the drawings are bird figurines and an angel figurine, but the invention is tended to capture anything at all.

Between the bird figurines 12 and 14 is a decorative ribbon 20 which is not only decorative (used in a broad sense), but is also elongate and flexible. Between the bird figurines 16 and 18 is a string of faux pearls 22 which likewise is elongate and flexible. Any decorative member can be disposed between the figurines in accordance with the present invention. Preferably, the member is somewhat elongate and somewhat flexible. It could be a string of lights, a string of popcorn, garland, etc. While the elongate members shown in FIG. 1 are arranged generally horizontally, they could be arranged on an angle or even vertically.

Figure 2:
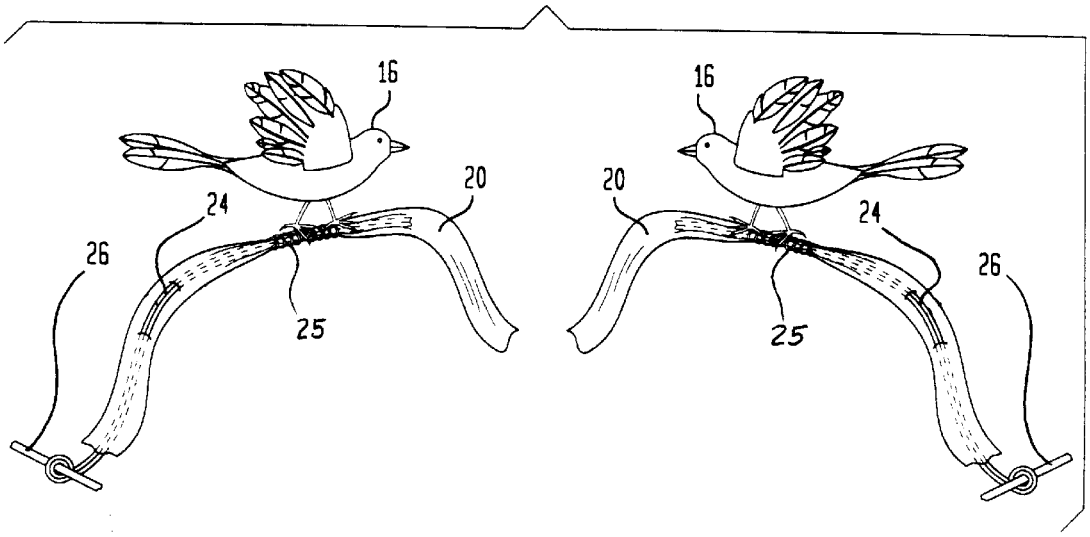
FIG. 2 is an elevational view of a pair of bird figurines having a decorative ribbon therebetween and illustrating in particular the manner in which an elongate spacer can be attached to the branch of a tree.
Figure 3:
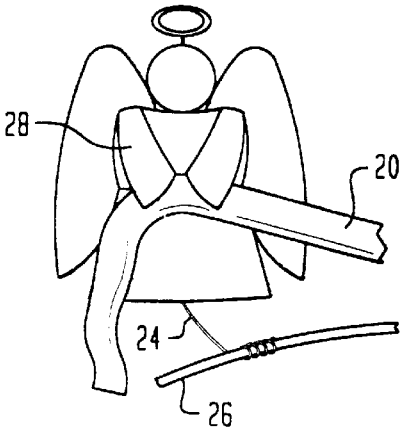
FIG. 3 is an elevational view of an angel figurine having a ribbon attached thereto and being attached to a tree branch.

Also shown in FIG. 1, but better seen in FIGS. 2 and 3, is an elongate spacer 24. In one embodiment, the spacer 24 is a wire which can be wrapped around a branch 26, as shown in FIGS. 2 and 3, yet is stiff enough to keep the figurines away from the tree to give the appearance of flying, floating, etc. It is thus in this embodiment a combined elongate spacer and fastening device. The specific appearance to be emulated depends upon the figurine to be used and the decorative elongate and flexible member to be used. Any spacer at all can be used, including the combination of a long wire-like or other structure together with another device for attaching that wire-like or other structure to a branch or other structure on the tree. By way of example, cable ties might be used, clips might be used, a separate wire-like item might be used, a hanging device might be used (preferably, on trees which are not conical in shape like a Christmas tree if the figurine is to be spaced from the tree), or any number of suitable fastening devices. Outside of the preferred embodiment illustrated and described herein, any fastening device at all can be used, whether supporting the figurine from above or below. A fastening device might be provided to attach the figurine to the trunk of the trunk 10[1] of a tree 10, or in the case of artificial trees, the pole of the tree. It is also contemplated that the figurines and elongate flexible number there between can be hung from a ceiling so as to provide the same effect.

It is also noted that the attachment of the spacer to the figurine can be accomplished in any suitable manner, including those ways described with respect to fastening to the tree.

It is noted particularly that the figurines 12 and 14 are fastened directly to or very close to the branches of the tree 10. Here, the ribbon can be attached to the figurines or to the tree branches. Also, the fastening device need not be elongate to emulate flying or floating. The bird has "landed." Where there is a pair of figurines, one of the pair could be attached directly to the tree branches, as in bird figurines 12 and 14, and the other figurine can be spaced away from the tree, as in bird figurines 16 and 18.

It is also noted that the elongate flexible member between the figurines can be held between the figurines in any suitable manner. The attachment of the elongate, decorative and flexible member to the figurine is again contemplated in any manner suitable with respect to the particular figurine and the decorative affect to be exhibited. In FIG. 2, the figurines 16 and 18, shown this time with a ribbon 20 therebetween, illustrate the ribbon being disposed around the elongate spacer/fastening device 24, whereby the elongate spacer/fastening device 24 is attached to the feet of the bird figurines. Indeed, the elongate spacer/fastening device 24 can be part of the elongate flexible member or vice versa.

While the elongate spacer/fastening device 24 can be attached to the figurine in the same manner as it is attached to the branch 26 (or in any manner at all), in FIG. 2, the feet of the bird figurine are made up of a covered wire 25 which extends beyond the feet in an uncovered manner in order to wrap around the elongate spacer/fastening member 24.

In the embodiment shown in FIG. 2, the appearance of the bird figurines carrying the ribbon by their feet is exhibited, and the fastening device is substantially hidden. Of course, the ribbon 20 can be held anywhere on the figurine, and in FIG. 1, it is shown that the string of pearls between figurines 16 and 18 are held by the beaks of the bird figurines. Also, the elongate spacer/fastening device can be thin enough that it is not very visible, made in the same color as the tree (for instance green) or the background behind the tree, or can be occluded at least partially by a portion of the figurine. It is contemplated that the fastening device 24 can be a part of the figurine itself, for instance a leg.

With respect to attaching the figurines to the trunk or pole of a tree, the fastening device 24 might extend outwardly like a branch, between the branches of the tree. And such fastening to the trunk can be accomplished in many different ways, screws, cable ties, a collar around the tree, and a slot or hole in the tree trunk or pole (much like those which accomodate fake branches on a fake tree).

In FIG. 3, an angel 28 is shown as the figurine carrying a ribbon 20. In this particular embodiment, the gown of the angel partially occludes the fastening device 24, and the ribbon 20 is held in the hands of the angel 28.

While the foregoing description and figures illustrate some preferred embodiments of the tree decoration in accordance with the present invention, it should be appreciated that certain modifications may be made and are encouraged to be made in the structure, arrangement of materials that are disclosed in the embodiments without departing from the spirit and scope of the present invention which are generally defined by the claims which are set forth immediately hereafter.

What is claimed:

1. A method of decorating a tree comprising the steps of:

a. attaching a figurine to a tree or a location such that the figurine is adjacent to the tree;

b. arranging an elongate decorative member having a first end and a second end such that the first end is at least adjacent to the figurine, including joining the elongate decorative member and the figurine;

c. extending the elongate decorative member on or adjacent to the tree; and d. arranging the second end of the elongate decorative member at a location remote from the first end of the elongate decorative member and at least adjacent to the tree, wherein the figurine and the elongate decorative member together exhibit a decorative arrangement on the tree.

2. The method in claim 1, wherein the step of arranging the figurine includes connecting the figurine to a tree branch by an elongate spacer to thereby space the figurine laterally away from the tree.

3. The method in claim 2, wherein the step of arranging the elongate decorative member includes the arrangement of such member with respect to the elongate spacer so as to at least partially occlude such elongate spacer.

4. The method in claim 2, wherein the figurine is a bird figurine having a beak, and the step of arranging the elongate decorative member includes attaching the first end thereof to the beak of the bird figurine.

5. The method in claim 2, wherein the elongate spacer has a bendable portion, and the step of arranging the figurine includes wrapping the bendable portion of the elongate spacer about the branch of a tree.

6. The method in claim 1, wherein the step of arranging the figurine includes arranging two figurines, and attaching an elongate spacer to at least one of the figurines, and fastening the elongate spacer with the figurine thereon to the tree such that the figurine is spaced laterally away from the tree.

7. The method in claim 6, wherein the step of arranging the elongate decorative member includes attaching the elongate decorative member to the spaced figurine or the elongate spacer.

8. The method in claim 7, wherein the elongate decorative member is arranged so that it least partially occludes a view of the elongate spacer.

9. The method in claim 8, wherein a second elongate spacer is attached to the second figurine and attached to the tree in such a way that the second figurine is spaced laterally away from the tree.

10. The method in claim 9, wherein the elongate decorative member is a ribbon, and the figurines are birds.

11. The method in claim 10, wherein the ribbon is attached to the first and second figurines or the first and second elongate spacers in such a way as to at least partially occlude the elongate spacers.

12. The method in claim 10, wherein the figurines are angels and wherein the elongate member is a ribbon, and wherein the ribbon is attached to the first and second figurines or the first and second elongate spacers in such a way as to at least partially occlude the elongate spacers.

13. A tree decoration comprising:

a. a figurine;

b. an elongate decorative member attached to said figurine, said elongate decorative member being so constructed and decorative that it can be extended on or adjacent to a tree at a location remote from said figurine to provide a decorative arrangement together with said figurine; and c. a fastener adapted to fasten said figurine to a tree.

14. The tree decoration in claim 13, further including an elongate spacer for attachment to the figurine so as to space the figurine laterally away from a tree.

15. The tree decoration in claim 14, wherein the fastener and the elongate spacer are integral.

16. The tree decoration in claim 14, further including a second figurine, a second elongate decorative member and a second elongate spacer, wherein the decorative member is attached to the figurine and arranged with respect to the elongate spacer so that the elongate decorative member at least partially occludes a view of the elongate spacer, and wherein the elongate decorative member is flexible.

17. The tree decoration in claim 16, wherein the elongate decorative member has a first end attached to a first figurine and a second end attached to the second figurine.

18. The tree decoration in claim 17, wherein said figurines are birds, and the elongate flexible member is a ribbon.

19. A decorative article of manufacture comprising:

a. a tree;

b. first and second figurines spaced from one another and arranged with respect to the tree;

c. at least one elongate spacer arranged between at least one figurine and the tree so as to space at least one figurine laterally away from the tree;

d. a fastener fastening said at least one elongate spacer to the tree; and e. an elongate decorative flexible member extending between the first and second figurines, and being disposed between the first and second figurines about the tree, said elongate decorative member being so constructed and decorative that it exhibits a decorative arrangement together with said figurine.

20. The decorative article of manufacture in claim 19, wherein the figurines are birds and the elongate flexible member is a ribbon.

21. The decorative article of manufacture in claim 19, wherein the elongate spacer and fastener are an integral wire-like device, and that device is wrapped around a branch of the tree.

22. The method of claim 1, wherein a second elongate spacer is attached to a second figurine and said second spacer is attached to the tree in such a way that the second figurine is spaced laterally away from the tree.

* * * * *